US009372043B2

(12) United States Patent
Larson, Jr. et al.

(10) Patent No.: US 9,372,043 B2
(45) **Date of Patent: *Jun. 21, 2016**

(54) FIREARM WITH MAGAZINE RELEASE LEVER

(71) Applicant: Rock River Arms, Inc., Colona, IL (US)

(72) Inventors: Lester C. Larson, Jr., Colona, IL (US); Mark Larson, Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/886,780

(22) Filed: Oct. 19, 2015

(65) Prior Publication Data

US 2016/0033223 A1 Feb. 4, 2016

Related U.S. Application Data

(63) Continuation of application No. 14/056,130, filed on Oct. 17, 2013, now Pat. No. 9,194,638.

(60) Provisional application No. 61/779,121, filed on Mar. 13, 2013, provisional application No. 61/715,119, filed on Oct. 17, 2012.

(51) Int. Cl.

| | |
|---|---|
| ***F41A 3/66*** | (2006.01) |
| ***F41A 17/38*** | (2006.01) |
| ***F41A 19/11*** | (2006.01) |
| ***F41A 19/10*** | (2006.01) |

(Continued)

(52) U.S. Cl.

CPC . *F41A 17/38* (2013.01); *F41A 3/66* (2013.01); *F41A 19/10* (2013.01); *F41A 19/11* (2013.01); *F41A 21/00* (2013.01); *F41C 23/16* (2013.01)

(58) Field of Classification Search

CPC ..... F41A 9/61; F41A 9/64; F41A 9/65; F41A 3/64; F41A 3/66; F41A 3/00; F41A 5/00; F41A 5/02; F41A 5/18; F41A 5/30; F41A 19/11; F41A 21/00

USPC ..... 42/75.03, 6, 49.01, 17, 18, 21, 22; 89/191.01, 191.02, 193, 128

See application file for complete search history.

(56) References Cited

U.S. PATENT DOCUMENTS

| | | | |
|---|---|---|---|
| 2,590,858 | A | 4/1952 | Harvey |
| 3,713,242 | A | 1/1973 | Seifried |

(Continued)

FOREIGN PATENT DOCUMENTS

| | | | |
|---|---|---|---|
| DE | 10353154 | B3 | 2/2005 |
| WO | 2008140833 | A2 | 11/2008 |

OTHER PUBLICATIONS

International Search Report issued in corresponding International Application No. PCT/US2013/071716 date of mailing on Aug. 6, 2014.

*Primary Examiner* — Jonathan C Weber

(74) *Attorney, Agent, or Firm* — Banner & Witcoff, Ltd.

(57) ABSTRACT

An AR-style firearm includes a specially designed lower receiver, a specially designed upper receiver mounted to the lower receiver, a pistol hand grip mounted to the lower receiver, a handguard mounted around a barrel, a specially designed magazine well formed in the lower receiver that is configured to receive an AK-47 magazine or similar magazine, and a specially designed, ambidextrous magazine release that holds and selectively releases the magazine from the magazine well.

20 Claims, 11 Drawing Sheets

(51) Int. Cl.
*F41A 21/00* (2006.01)
*F41C 23/16* (2006.01)

(56) References Cited

U.S. PATENT DOCUMENTS

| | | | |
|---|---|---|---|
| 3,857,322 | A | 12/1974 | Lichtman |
| 3,960,053 | A | 6/1976 | Conley |
| 4,237,638 | A | 12/1980 | Trexler |
| 4,276,708 | A | 7/1981 | Chase |
| 4,640,036 | A | 2/1987 | Gal |
| 4,709,496 | A | 12/1987 | Johnson |
| 5,012,604 | A | 5/1991 | Rogers |
| 5,235,771 | A | 8/1993 | Sokol et al. |
| 5,452,534 | A | 9/1995 | Lambie |
| 5,827,992 | A | 10/1998 | Harris et al. |
| 5,854,440 | A | 12/1998 | Canaday et al. |
| 5,926,989 | A | 7/1999 | Oliver, Sr. |
| 5,980,242 | A | 11/1999 | Man |
| 6,182,389 | B1 | 2/2001 | Lewis |
| 6,634,128 | B1 | 10/2003 | Vastag |
| 6,634,129 | B1 | 10/2003 | Freeman, Jr. |
| 6,708,685 | B2 | 3/2004 | Masse |
| 6,968,642 | B1 | 11/2005 | Leung |
| 7,000,345 | B1 | 2/2006 | Kay |
| 7,219,462 | B2 | 5/2007 | Finn |
| 7,261,029 | B1 | 8/2007 | Davis |
| 7,275,327 | B2 | 10/2007 | Deien |
| 7,444,775 | B1 | 11/2008 | Schuetz |
| D584,373 | S | 1/2009 | Young |
| D596,693 | S | 7/2009 | Nakayama |
| 7,596,900 | B2 | 10/2009 | Robinson et al. |
| 7,753,679 | B1 | 7/2010 | Schuetz |
| 7,810,271 | B2 | 10/2010 | Patel |
| D627,415 | S | 11/2010 | Finn |
| 8,429,844 | B2 | 4/2013 | Dextraze et al. |
| 8,468,929 | B2 | 6/2013 | Larson et al. |
| 8,522,465 | B2 | 9/2013 | Jarboe et al. |
| 8,661,963 | B2 | 3/2014 | Patel |
| 2005/0183310 | A1 | 8/2005 | Finn |
| 2005/0183317 | A1 | 8/2005 | Finn |
| 2006/0026883 | A1 | 2/2006 | Hochstrate et al. |
| 2006/0156606 | A1 | 7/2006 | Robinson et al. |
| 2006/0265925 | A1 | 11/2006 | Murello |
| 2009/0031605 | A1 | 2/2009 | Robinson |
| 2009/0120420 | A1 | 5/2009 | Tippmann, Jr. et al. |
| 2009/0241395 | A1 | 10/2009 | Barnett |
| 2009/0241931 | A1 | 10/2009 | Masse |
| 2010/0162604 | A1 | 7/2010 | Dubois |
| 2010/0229445 | A1 | 9/2010 | Patel |
| 2010/0307042 | A1 | 12/2010 | Jarboe et al. |
| 2012/0047786 | A1 | 3/2012 | Dextraze et al. |
| 2012/0159828 | A1 | 6/2012 | Jarboe et al. |
| 2012/0167433 | A1 | 7/2012 | Robbins et al. |
| 2012/0204713 | A1 | 8/2012 | Patel |
| 2013/0326924 | A1 | 12/2013 | Jarboe et al. |
| 2014/0230298 | A1 | 8/2014 | King, Jr. |

FIREARM WITH MAGAZINE RELEASE LEVER

CROSS REFERENCE TO RELATED APPLICATIONS

This application is a continuation application of application Ser. No. 14/056,130, filed Oct. 17, 2013, which claims priority to U.S. Provisional Application No. 61/715,119, filed Oct. 17, 2012, and to U.S. Provisional Application No. 61/779,121, filed Mar. 13, 2013, each of which is incorporated herein by reference.

FIELD

The present invention relates generally to firearms and more particularly to an improved AR-style firearm that also accepts AK-47 magazines.

BACKGROUND

It is known that an AR-style rifle is a lightweight, magazine-fed, semi-automatic rifle used by military personnel and popular among civilians. The AR-style rifle includes a rotating-lock bolt that may be actuated by either a direct or indirect gas impingement system.

It is also known that the AK-47 rifle is one of the most widely used and popular rifles in the world because of its durability, low production cost, availability, and ease of use. It is a selective-fire, gas-operated rifle that typically uses 7.62× 39 mm ammunition. One factor in the firearm's reliability is the design of its magazine. The AK-47 has a magazine with a pronounced curve which allows it to smoothly feed ammunition into the chamber. The magazine's steel construction combined with feed lips (i.e., the surfaces at the top of the magazine that control the angle at which the cartridge enters the chamber), which are machined from a single steel billet makes it highly resistant to damage. Additionally, due to the world-wide popularity of the AK-47 rifle, there are an abundance of AK-47 magazines available for use.

There remains a need, however, for an AR-style rifle that can accept an AK-47 magazine.

SUMMARY

In an embodiment of the invention, an AR-style firearm includes a specially designed lower receiver, a specially designed upper receiver mounted to the lower receiver, a pistol hand grip mounted to the lower receiver, a handguard mounted around a barrel, a specially designed magazine well formed in the lower receiver that is configured to receive an AK-47 magazine or similar magazine, a specially designed barrel extension, and a specially designed, ambidextrous magazine release that holds and selectively releases the magazine from the magazine well.

In an embodiment, a firearm combines an AR-style rifle with an AK-47 style magazine or similar magazine. The firearm may include a lower receiver, an upper receiver mounted to the lower receiver, a barrel extension mounted to the upper receiver, wherein the barrel extension defines a wide feed ramp, and a barrel mounted to the barrel extension. The firearm may also include a handguard surrounding at least part of the barrel, a pistol grip mounted to the lower receiver, and an elongated mounting rail positioned above the upper receiver. The firearm may also include a stock mounted to the upper receiver, a trigger and trigger assembly mounted to the lower receiver, and a trigger guard that extends at least partially around the trigger and is mounted to the lower receiver. The lower receiver defines a magazine well and an elongated groove formed in the magazine well for receiving an AK-47 style magazine. The magazine well also defines an angled opening for receiving the AK-47 style magazine. In an exemplary aspect, the angled opening extends from a trigger guard mounting hole to a take-down pin hole.

The firearm of the embodiment may also include an ambidextrous magazine release lever located between the magazine well and the trigger. The magazine release lever may define a first end forming a magazine catch and a second end forming a pair of paddles that straddle the trigger guard. The magazine catch may extend into the magazine well and may be spring biased towards the magazine well. The magazine catch may be configured to engage a tabbed portion of the AK-47 style magazine upon insertion of the magazine into the magazine well. The paddles that straddle the trigger guard may be operable from either side of the firearm. In an alternative aspect, the magazine catch defines an angled end for engagement with the tabbed portion of the AK-47 style magazine.

The firearm of the embodiment may also include a bolt, bolt carrier and an oversized extractor mounted to the bolt. The bolt may define relief cuts to permit the oversized extractor to move easily relative to the bolt. A charging handle may be operatively mounted to the bolt carrier. In an exemplary aspect, the paddles of the release lever may define serrations on the paddle surfaces. In another aspect, the lever may extend into an opening defined by the trigger guard and may also extend toward the magazine well. The lever may define a radius that is concentric with the trigger guard mounting hole used to mount the trigger guard to the lower receiver. In yet another aspect, the trigger guard may include opposing cuts at an end to permit the trigger guard to mount to trigger guard mounting walls on the lower receiver. Additionally, the trigger guard may extend from the trigger guard mounting hole located behind the magazine well towards the magazine well and then curve back towards and beneath the trigger and then curve towards the trigger guard mounting walls.

In yet another embodiment, a firearm combines an AR-style rifle with an AK-47 style magazine or similar magazine. The firearm may include a lower receiver, an upper receiver mounted to the lower receiver, a barrel extension mounted to the upper receiver, wherein the barrel extension defines a wide feed ramp, and a barrel mounted to the barrel extension. The firearm may also include a handguard surrounding at least part of the barrel, a pistol grip mounted to the lower receiver, and an elongated mounting rail positioned above the upper receiver. The firearm may also include a stock mounted to the upper receiver, a trigger and trigger assembly mounted to the lower receiver, and a trigger guard that extends at least partially around the trigger and is mounted to the lower receiver. The lower receiver may define a magazine well and an elongated groove or channel formed in the magazine well for receiving the tabbed portion of an AK-47 style magazine. The magazine well also defines an angled opening for receiving the AK-47 style magazine. In an exemplary aspect, the angled opening extends from a trigger guard mounting hole to a take-down pin hole.

The firearm of the embodiment may also include an ambidextrous magazine release lever located behind the magazine well and above trigger. In an exemplary aspect, the magazine release lever may define a first end forming a magazine catch and a second end forming a pair of lever arms that extend across both sides of the firearm and above the trigger. The lower receiver may define cuts on both sides of the firearm that serve as a rotational stop for the lever. The magazine catch may extend into the magazine well and may be spring biased towards the magazine well. The magazine catch may be configured to engage the tabbed portion of the AK-47 style magazine upon insertion of the magazine into the magazine well. The lever arms that extend along both sides of the lower receiver may be operable from either side of the firearm. In an alternative aspect, the magazine catch defines an angled end for engagement with the tabbed portion of the AK-47 style magazine.

The firearm of the embodiment may also include a bolt, bolt carrier and an extractor mounted to the bolt. The bolt may define relief cuts to permit the extractor to move easily relative to the bolt. A charging handle may be operatively mounted to the bolt carrier. In an exemplary aspect, the lever arms may define ends that further define serrations on the ends. The lever arms may be joined by a bracket extending between the lever arms. The bracket may define a cut for receiving a torsion spring. In yet another aspect, the trigger guard may include opposing cuts at an end to permit the trigger guard to mount to trigger guard mounting walls on the lower receiver. Additionally, the trigger guard may extend from the trigger guard mounting hole located behind the magazine well towards the magazine well and then curve back towards and beneath the trigger and then curve towards the trigger guard mounting walls. The mounting rail may be configured to mount firearm accessories, including sights, lights and optics.

DESCRIPTION OF DRAWINGS

The present invention is illustrated by way of example and not limited in the accompanying figures in which like reference numerals indicate similar elements and in which.

DESCRIPTION OF THE EMBODIMENTS

Figure 1:
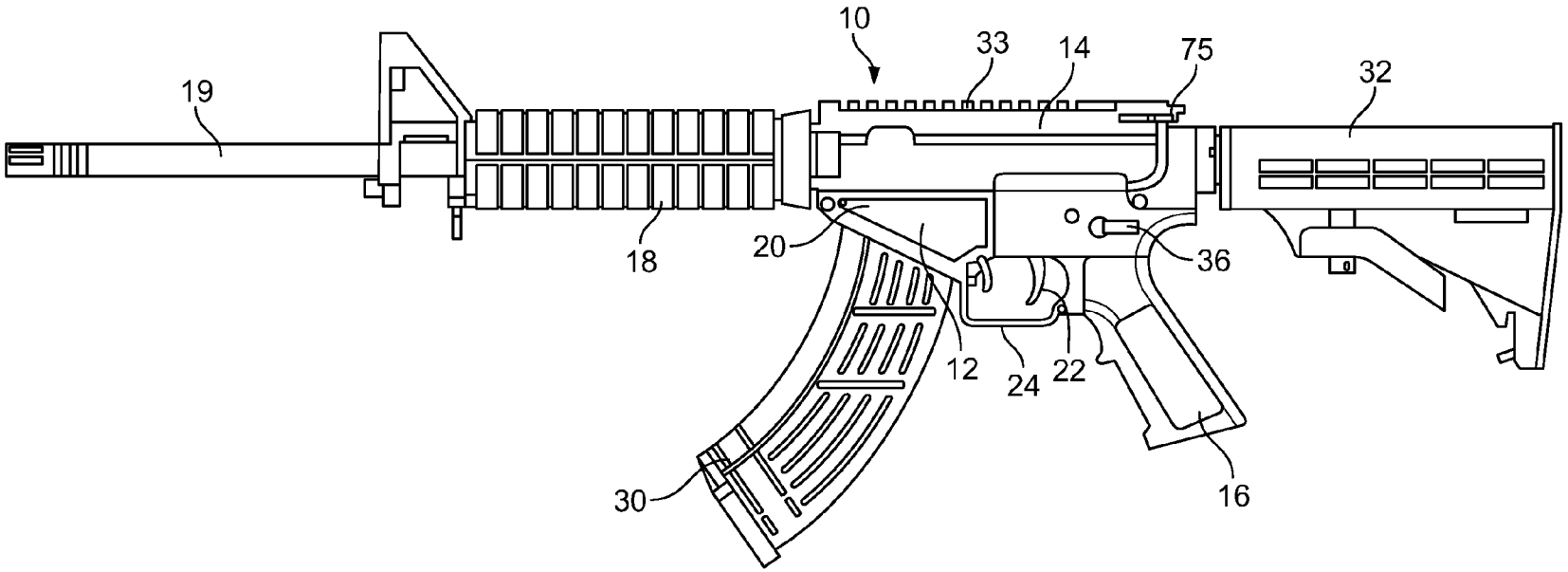
FIG. 1 illustrates a side view of an exemplary firearm for use with the teachings of the invention.

Referring to FIG. 1, the firearm 10 of the invention may include a lower receiver 12, an upper receiver 14 mounted to the lower receiver, a hand grip 16 mounted to the lower receiver, a handguard 18 mounted around a barrel 19, and a magazine well 20 formed in the lower receiver for receiving AK-47 style magazines 30 or similar magazine types. The handguard 18 may be a CAR handguard, a quad rail handguard, or other handguard. The barrel 19 may be chrome lined, chrome moly, aluminum or other suitable barrel type. The firearm may also include a trigger 22 and a trigger guard 24 that is pinned to the lower receiver and located between the magazine well 20 and the hand grip 16. In an exemplary embodiment, the trigger may be a two-stage trigger. Mounted to the back end of the upper receiver is an adjustable butt stock 32. The stock 32 may be a 6-position tactical stock, or another suitable stock. A picatinny rail 33 may be included on the top side of the upper receiver for mounting iron sights, optics and/or lights. The firearm 10 may be in the form of a pistol, carbine or a rifle. In an exemplary embodiment, the firearm 10 is chambered to receive 7.62×39 mm ammunition. The firearm 10 may also be configured to receive other ammunition calibers.

The lower receiver may include a safety selector 36 for providing a safe and fire mode for the firearm. The safety selector is held to the receiver by a safety detent and safety detent spring. The lower receiver also includes a rebound buffer that is mounted to the inside end of the receiver through the use of a buffer screw, as understood in the art. One or more takedown pins may extend through openings 41, 44 in the side of the lower receiver to mount the lower receiver to the upper receiver. The firearm may include a bolt catch, bolt catch plunger, bolt catch spring, and bolt catch roll pin. The hand grip 16 may be a Hogue rubber pistol grip, an ERGO Sure-Grip, an A2 pistol grip, or another hand grip. The lower receiver 12 will include the trigger, hammer, springs and mounting pins that are used to fire the firearm.

Figure 2:
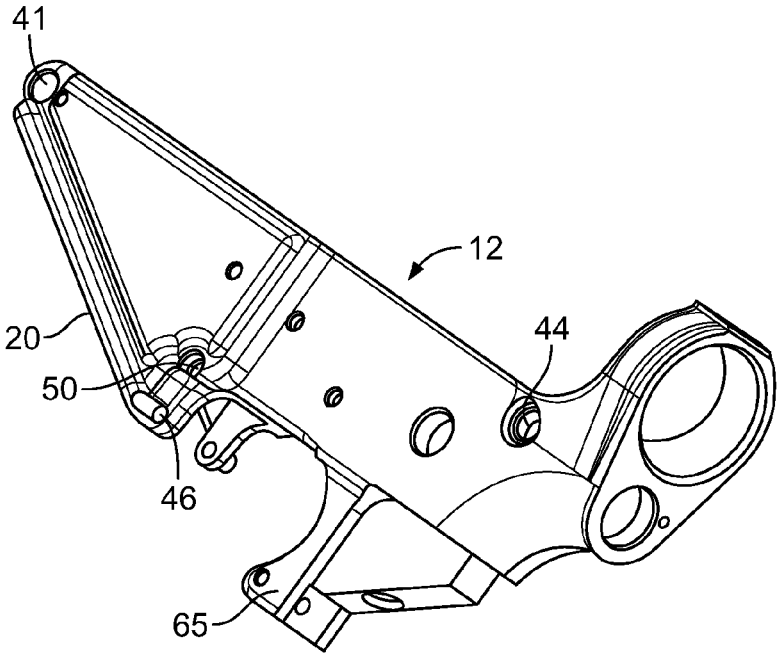
FIG. 2 illustrates an isometric view of an exemplary lower receiver of the firearm of FIG. 1.
Figure 3:
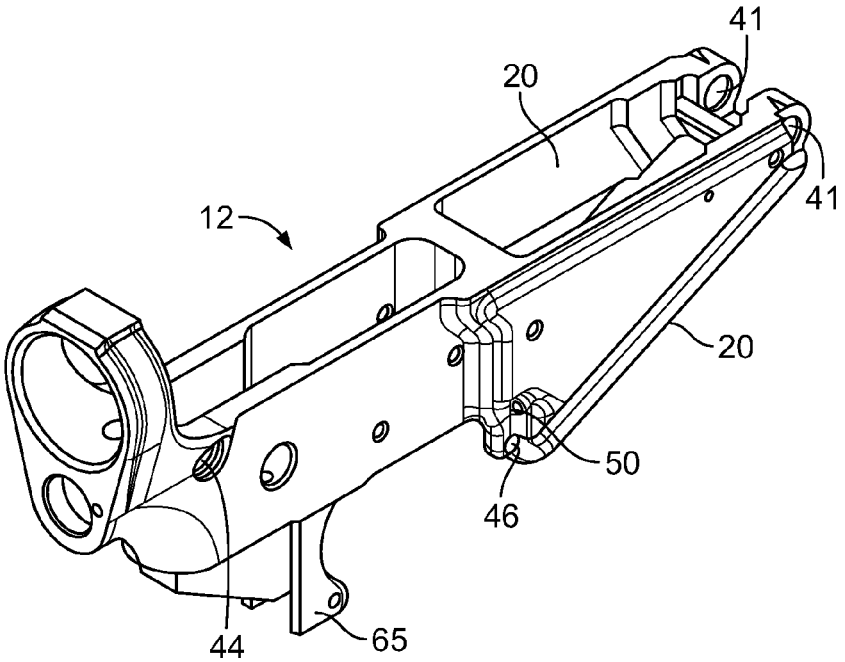
FIG. 3 illustrates another isometric view of an exemplary lower receiver of the firearm of FIG. 1.
Figure 4:
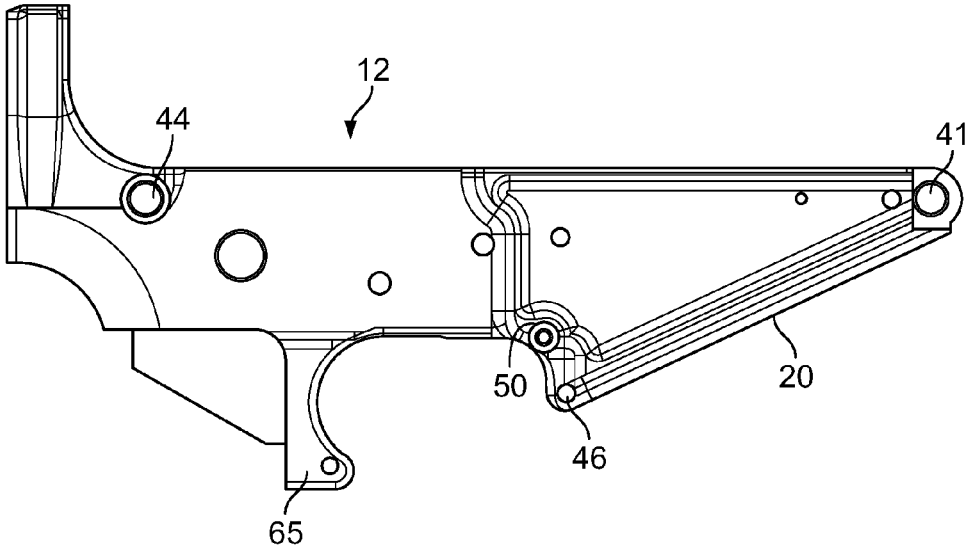
FIG. 4 illustrates a side view of an exemplary lower receiver of the firearm of FIG. 1.
Figure 5:
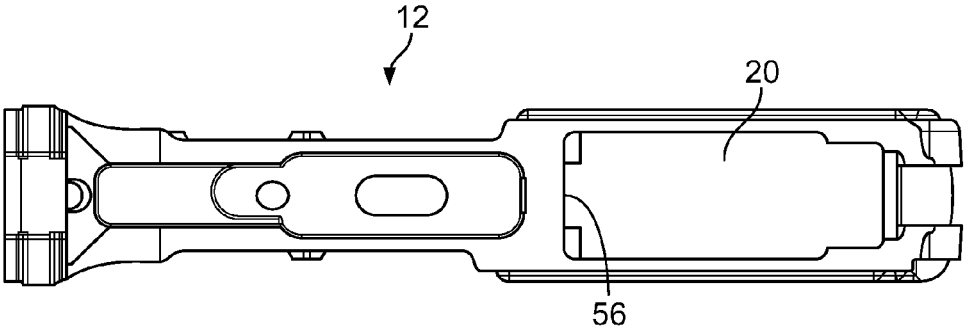
FIG. 5 illustrates a top view of an exemplary lower receiver of the firearm of FIG. 1.
Figure 6:
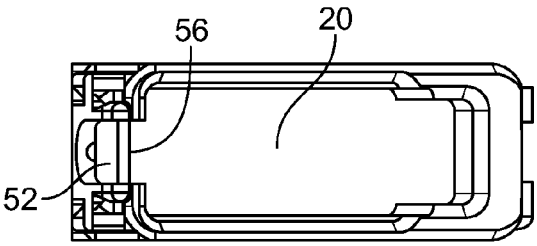
FIG. 6 illustrates a bottom view of an exemplary magazine well of the firearm of FIG. 1.
Figure 7:
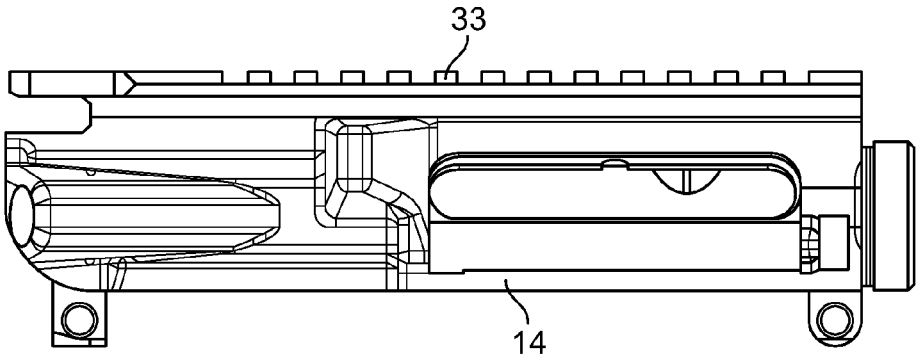
FIG. 7 illustrates a side view of an exemplary upper receiver of the firearm of FIG. 1.
Figure 8:
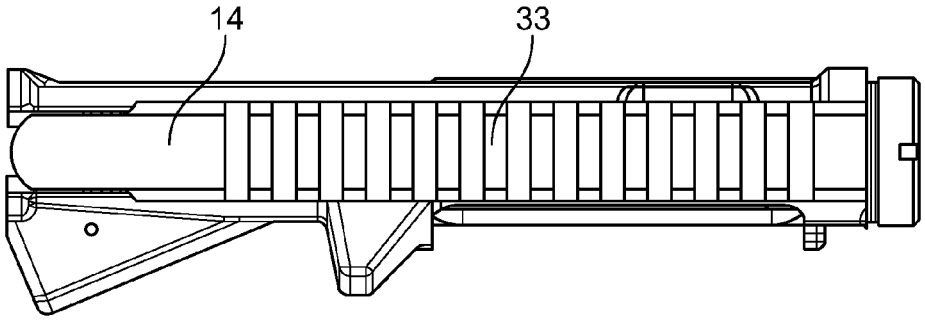
FIG. 8 illustrates a top view of an exemplary upper receiver of the firearm of FIG. 1.

Referring to FIGS. 2-4, the lower receiver 12 may define an angled magazine well 20 that is configured to accommodate an AK-47 magazine or similar magazine. The well opening is angled from trigger guard pin hole 46 to the takedown pin hole 41. This angled opening facilitates the easy insertion of the AK-47 magazine or similar magazine into the magazine well. Referring to FIGS. 5-6, the magazine well may define an elongated groove or channel 56 that is sized and shaped to receive the tabbed portion of the AK-47 magazine or similar magazine. The groove or channel 56 serves as a guide to align the magazine within the magazine well as it is inserted into the magazine well. In operation, as the magazine is inserted into the magazine well and along the groove or channel, the magazine will travel along the groove or channel until the magazine release, described below, contacts the underside of the tabbed portion of the magazine at which point the magazine release holds the magazine within the magazine well until such time as the magazine lever is pushed or moved to release the magazine from the magazine well.

Referring to FIGS. 2-4 and 26-27, in an exemplary embodiment, on both sides of the lower receiver 12 behind the magazine well are forged or machined cuts 50 that serve as a stop for the magazine release lever 100. The cuts 50 define a surface that will be contacted by the magazine release lever 100 and that prevents further rotational movement of the magazine release. In one aspect, the cuts extend horizontally along the sides of the firearm. In an alternative embodiment, one cut 50 may be located on a single side of the lower receiver behind the magazine well. The single cut will serve as a stop for the magazine release lever. The magazine release lever is spring loaded through the use of a torsion spring. Referring to FIG. 6, a hole or opening 52 is located in the lower receiver along its center line to incorporate the torsion spring.

Figure 11:
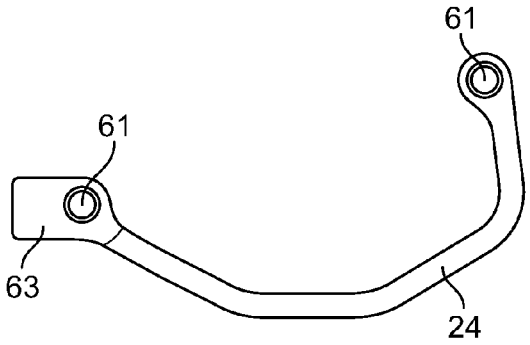
FIG. 11 illustrates a side view of an exemplary trigger guard of the firearm of FIG. 1.

Referring to FIG. 11, the firearm also includes a specially designed trigger guard 24 that defines a unique shape and that defines pin holes 61 used to pin the trigger guard to the lower receiver. The trigger guard is located between the magazine well and the hand grip. The trigger guard 24 may include opposing cuts 63 at an end to permit the trigger guard to mount to and to flow with the trigger guard mounting walls 65 on the lower receiver to give the firearm a seamless look. The trigger guard is shaped at its other end to extend towards the magazine well and then curve back towards and beneath the trigger and then curve towards the trigger guard mounting walls. The trigger guard is also designed to permit the magazine release lever 70 to wrap around the edges of the trigger guard, as explained below, and to give the firearm an aesthetically pleasing look and flow to the design. In an exemplary embodiment, the trigger may be a two-stage trigger.

Figure 30:
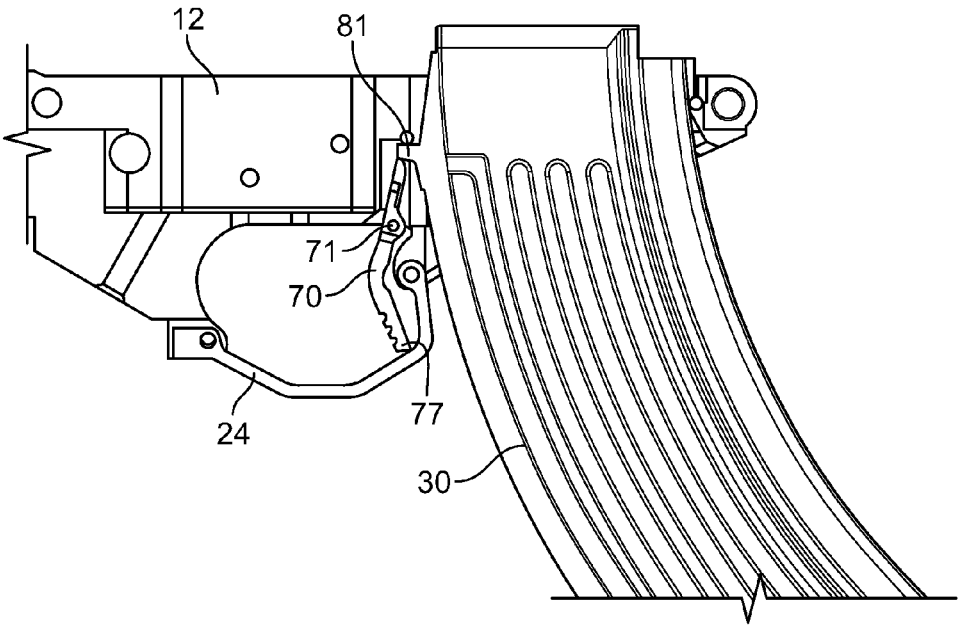
FIG. 30 illustrates a cut-away view of the exemplary magazine release of FIG. 12 mounted to the lower receiver and the magazine.
Figure 31:
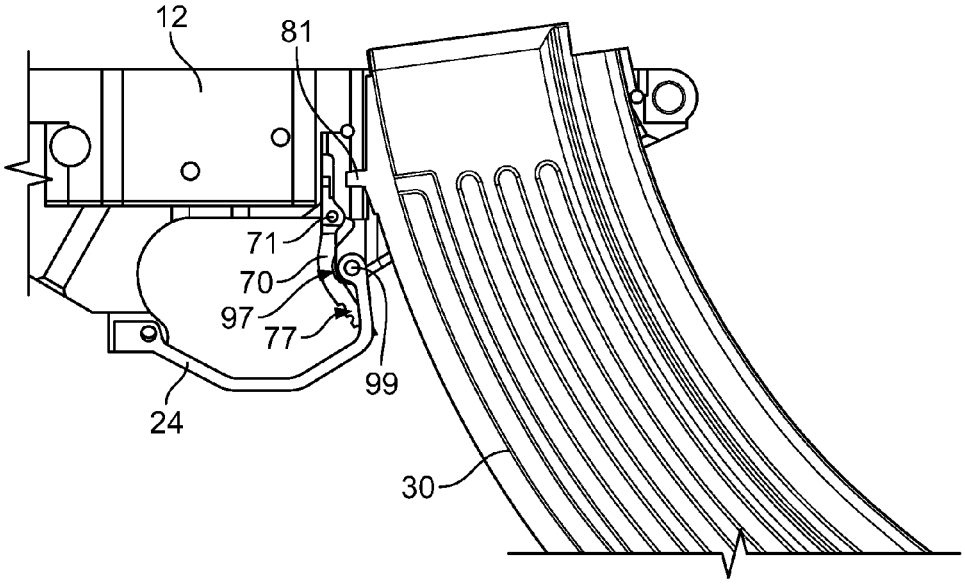
FIG. 31 illustrates a cut-away view of the exemplary magazine release of FIG. 12 mounted to the lower receiver.

Referring to FIGS. 12-14 and 30-31, the AK-47 magazine 30 or similar magazine may be released from the magazine well through the use of an ambidextrous release lever 70. This means the operator can operate the release lever from either side of the firearm or using either hand, depending on whether the operator is left-handed or right-handed. In an exemplary aspect, the release lever 70 may be pivotably connected to the lower receiver via a torsion spring and roll pin 71. As shown in FIGS. 30-31, the lever 70 is pinned to the lower receiver immediately behind the magazine well and above the trigger guard mounting location 91. This location permits sufficient clearance within the trigger guard area for an operator to insert his or her finger within the trigger guard area even wearing gloves and yet permit the operator quick and easy access to the release lever.

The lever 70 may define a magazine catch 73 at one end that operatively connects to or contacts the tabbed portion 81 of the AK-47 magazine 30. The magazine catch may define an angled cut 75 or chamfered end to permit it to catch and operatively release an AK-47 magazine. The magazine catch end 73 also defines an elongated slot (shown in FIGS. 12 and 14) which serves as a clearance cut to permit the mounting of the torsion spring used to bias the lever 70. There are numerous AK-47 magazine manufacturers making different AK magazines having different sized and shaped tabs with different dimensions. The angled cut 75 or chamfered end of the magazine catch 73 is designed to accommodate all of these magazines and their different shaped tabs, and thereby permit the use of these different magazines with the firearm 10.

Figure 12:
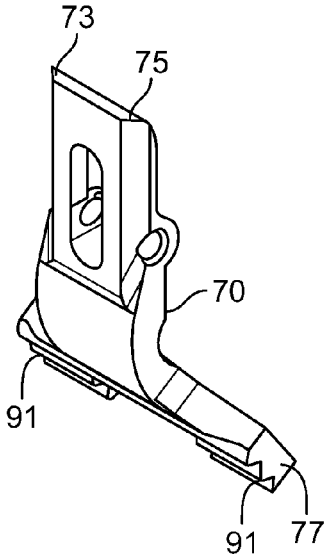
FIG. 12 illustrates an isometric view of an exemplary magazine release of the firearm of FIG. 1.
Figure 13:
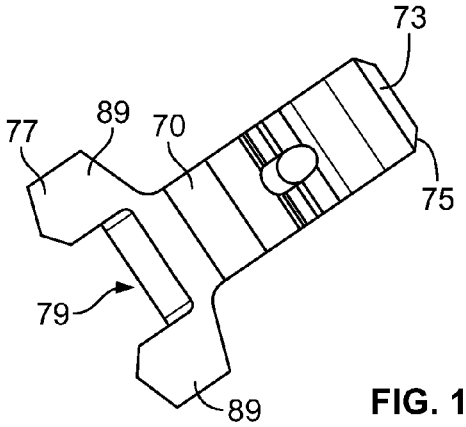
FIG. 13 illustrates a top view of an exemplary magazine release of the firearm of FIG. 1.
Figure 14:
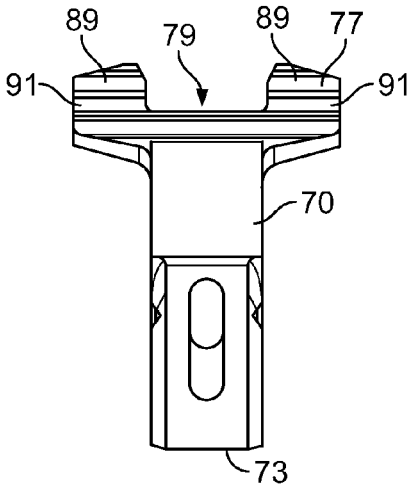
FIG. 14 illustrates a bottom view of an exemplary magazine release of the firearm of FIG. 1.

The other end 77 of the ambidextrous release lever 70 extends and wraps around the trigger guard. The end 77 directed toward the trigger is also angled relative to the magazine catch end 73 of the lever (as shown in FIG. 12) so that it extends substantially parallel with the trigger (and forward of the trigger) when the catch end 73 is engaged with the tabbed portion of the magazine (as shown in FIG. 30), and when pivoted toward the magazine well the end 77 will wrap around or straddle the trigger guard (as shown in FIG. 31). This is accomplished by a square shaped cut 79 made at the end of the lever to define opposing paddles 89. The square shaped cut 79 is sufficiently sized to permit the trigger guard to extend between the paddles 89. This design also gives more room within the trigger guard area for an operator to insert his or her finger in the trigger guard even wearing gloves. This location for the release lever 70 permits the operator to easily operate the release lever, and thus drop the magazine with the trigger finger without the operator having to move his or her finger or hand away from the trigger. This can be accomplished regardless of whether the operator is left-handed or right-handed. Serrations 91 may be added to the paddles 89 of the lever to enhance the grip on this surface.

Referring to FIG. 30, the magazine catch lever 70 is shown holding the AK-47 magazine in position within the magazine well. The paddles 89 extend into the trigger guard area but sufficiently forward of the trigger to permit the operator wearing gloves to insert a finger between the trigger and the paddles 89. Once the operator presses on or pushes the paddles 89 towards the magazine well, the lever 70 pivots about pivot pin 71 and the magazine catch 73 moves away from the tabbed portion of the magazine, as shown in FIG. 31. This permits the magazine to now drop down and out of the magazine well along the groove formed in the magazine well. The ambidextrous release lever 70 therefore may be used to hold the AK-47 magazine or similar magazine in the magazine well and also release the magazine from the well upon pressing the paddles 89 of the magazine release lever 70.

In an exemplary aspect, the lever 70 defines a radius 97 that is concentric with the mounting pin hole 99 used to mount the trigger guard 24 to the lower receiver 12. This configuration permits the lever to move around the mounting pin hole and the paddles 89 to properly straddle the trigger guard 24 as the lever is pressed and the magazine is released. A torsion spring, not shown, may be used to bias the magazine catch end 73 towards the magazine well.

Once a magazine is inserted into the well, the force exerted by the magazine on the catch end 73 overcomes the biasing force of the torsion spring and rotates the catch end 73 away from the magazine well until the tabbed portion 81 passes the catch end 73 at which point the biasing force of the torsion spring causes the catch end to rotate back towards the magazine well and underneath the tabbed portion 81, thereby catching and holding in position the magazine within the magazine well.

Referring to FIGS. 22-29, in an alternative embodiment, an ambidextrous release lever 100 may be pivotably connected to the lower receiver 12 via a torsion spring and roll pin. The lever 100 may define a magazine catch 102 at one end that operatively connects to the tabbed portion 81 of the AK-47 magazine 30. The magazine catch 102 may define an angled cut that will permit it to catch and permit the operative release of an AK-47 magazine.

The other lever end 104 of the ambidextrous release lever extends and wraps around both sides of the lower receiver above the trigger guard opening and above the trigger. The lever end 104 defines a lever arm that is directed above the trigger and is angled relative to the catch end of the lever so that the lever arm extends substantially horizontally above the trigger. This design also gives more room within the trigger guard area for an operator to insert his or her finger in the trigger guard even wearing gloves. This location for the release lever end 104, and the suitable length of the lever end, also permits the operator to easily operate the release lever, and thus drop the magazine, with the trigger finger without the operator having to move his or her finger or hand too far away from the trigger. This can be accomplished regardless of whether the operator is left-handed or right-handed because the end of the release lever and lever arm extends along both sides of the lower receiver. Other lengths of the lever end 104 are possible and are included within the scope of the invention. Serrations, checkering or texturing 106 may be added to the end 104 of the release lever to enhance the grip on this surface. The end 104 of the release lever may be angled for comfort and for an aesthetically pleasing look.

The lever ends 104 define lever arms that are joined together by a bracket 110. The magazine catch 102 extends outwardly from the bracket 110 to engage or catch the magazine tab. The bracket 110 further defines clearance cuts 112 for the lower receiver and a clearance cut 114 for the torsion spring, which is used to bias the magazine catch 102 towards the magazine well. The roll pin will extend through the apertures or holes 116 formed in the bracket to mount the bracket and thus the release lever to the lower receiver 12 of the firearm.

Figure 23:
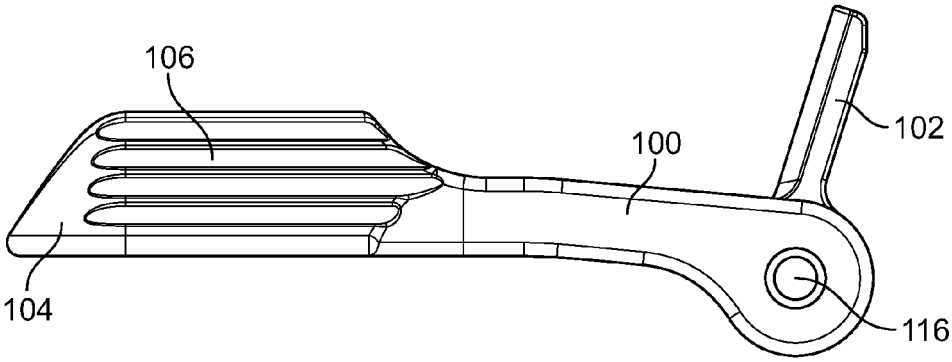
FIG. 23 illustrates a side view of the exemplary magazine release of FIG. 22.
Figure 24:
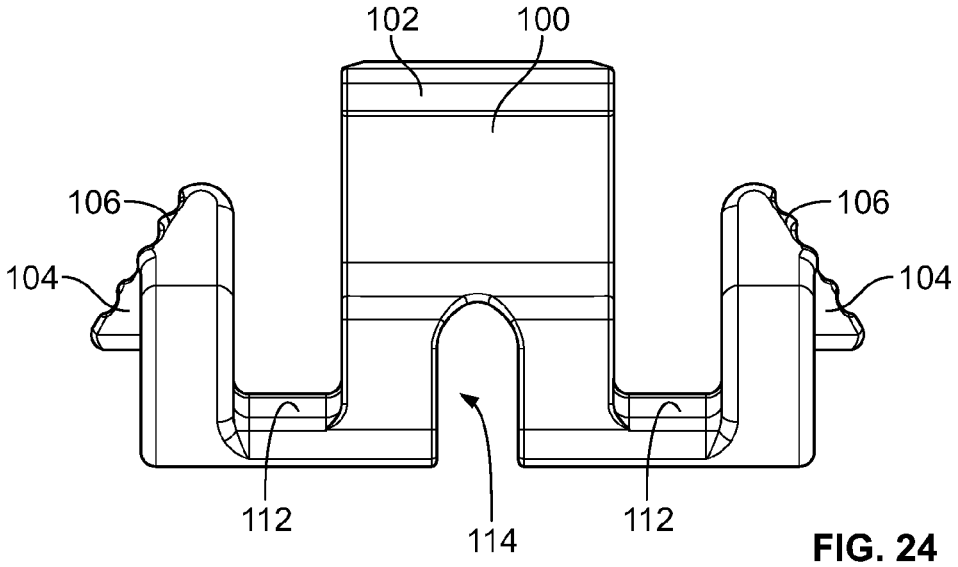
FIG. 24 illustrates an end view of the exemplary magazine release of FIG. 22.
Figure 25:
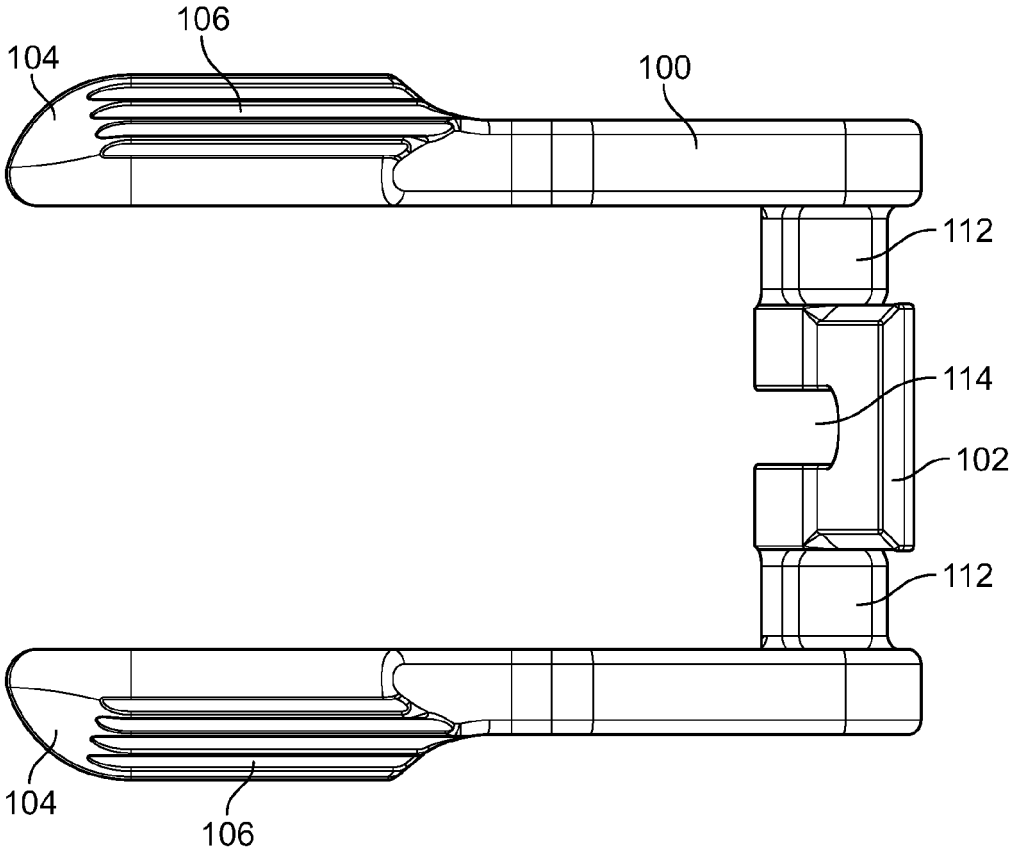
FIG. 25 illustrates a top view of the exemplary magazine release of FIG. 22.
Figure 26:
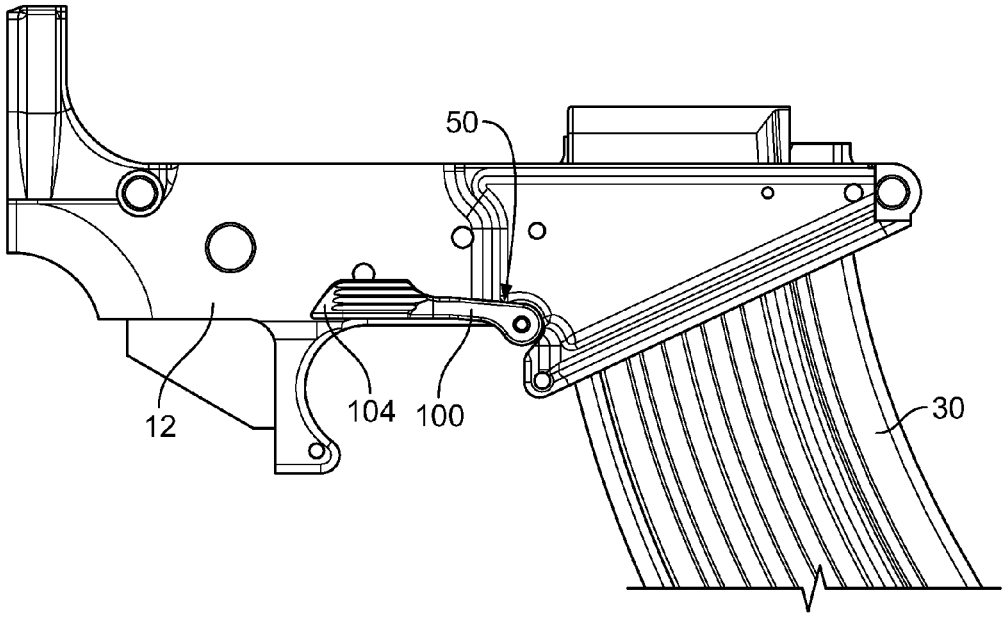
FIG. 26 illustrates a side view of the exemplary magazine release of FIG. 22 mounted to the lower receiver and the magazine.
Figure 27:
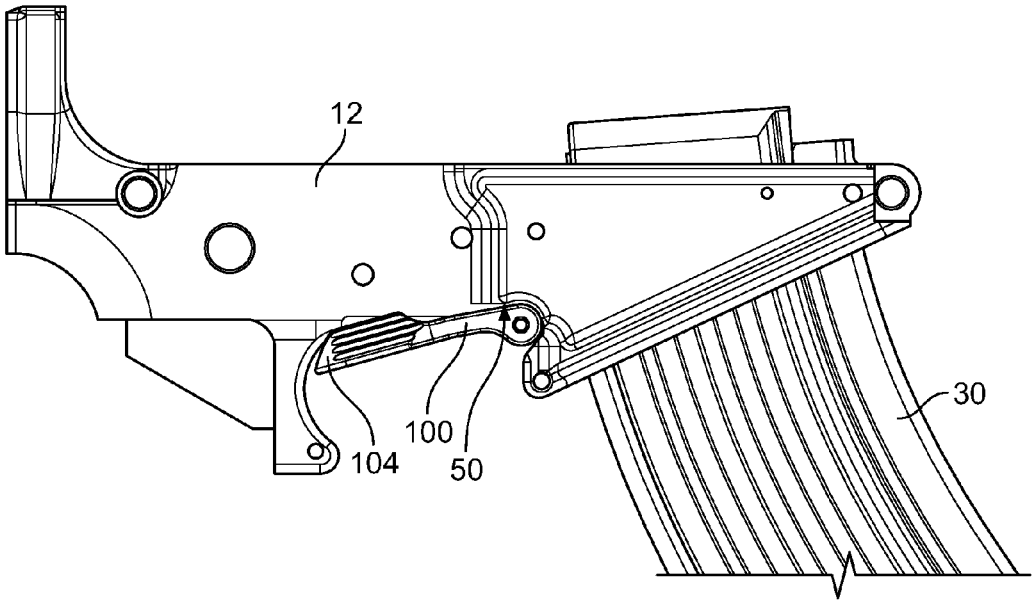
FIG. 27 illustrates a side view of the exemplary magazine release of FIG. 22 mounted to the lower receiver and the magazine.
Figure 28:
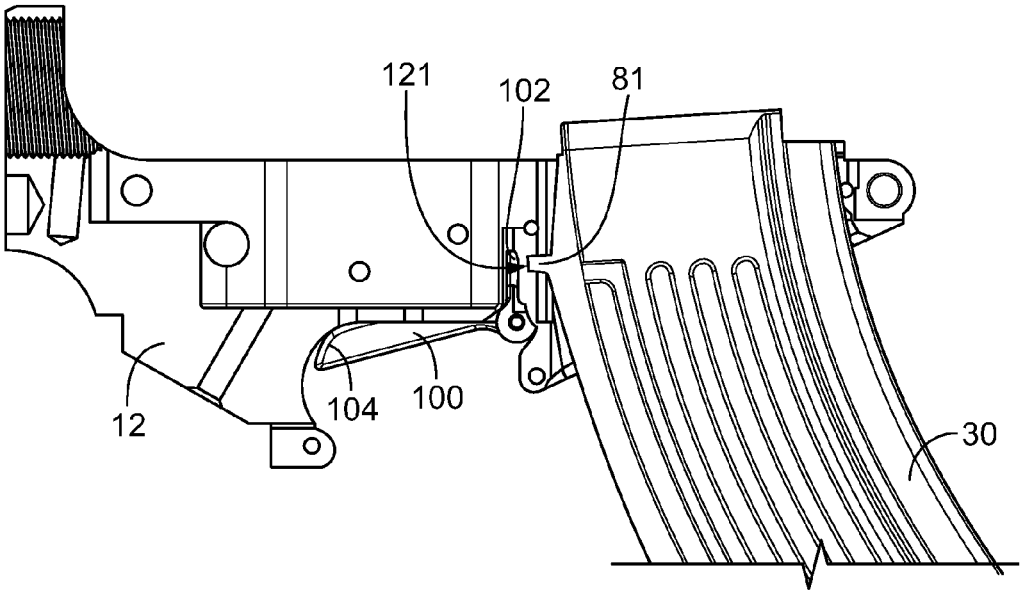
FIG. 28 illustrates a cut-away view of the exemplary magazine release of FIG. 22 mounted to the lower receiver.
Figure 29:
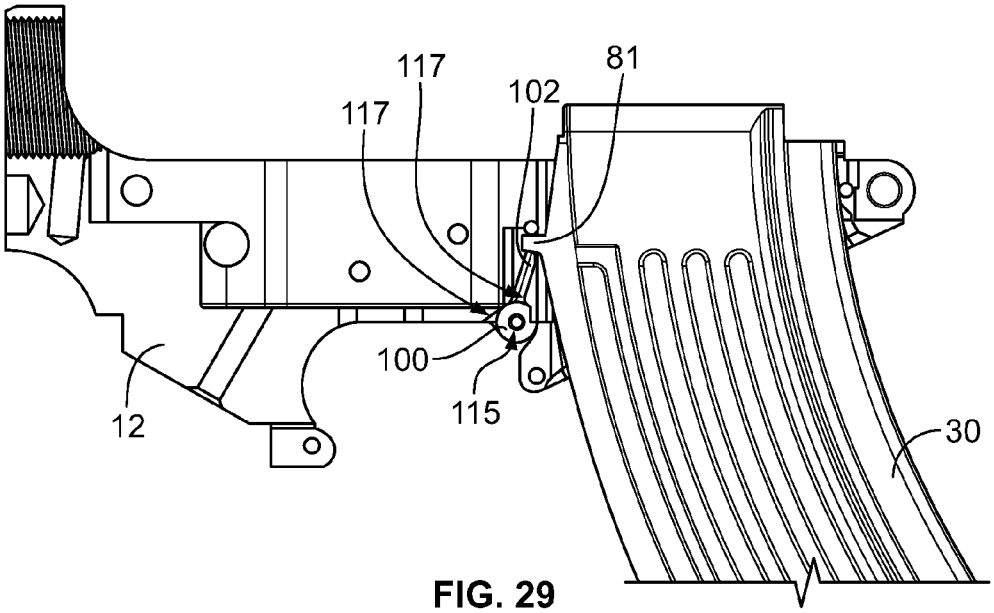
FIG. 29 illustrates a cut-away view of the exemplary magazine release of FIG. 22 mounted to the lower receiver and the magazine.

Once the operator presses on or pushes the lever arms 104, as shown in FIG. 27, from the right side or the left side of the firearm, the lever 100 pivots about pivot pin 115 located in the hole 116. This causes the magazine catch 102 to move away from the tabbed portion 81 of the magazine, as shown in FIG. 28 at 121. This permits the magazine to now drop down and out of the magazine well along the groove formed in the magazine well. The ambidextrous release lever 100 therefore is an alternative way to hold the AK-47 magazine in the magazine well and also release the magazine from the well upon pressing the lever ends or arms 104 of the magazine release lever 100. A torsion spring 117 may be located in the clearance cut 114 and may be used to bias the magazine catch end 102 towards the magazine well. The ends 104 will bias toward the lower receiver (as shown in FIG. 27) until the lever contacts the cuts 50 formed in the lower receiver (as shown in FIG. 26) which stops the rotational movement of the lever. At this position, the magazine catch 102 is now angled and positioned underneath the tabbed portion 81 of the magazine 30 to hold the magazine within the magazine well. As shown in FIG. 23, the magazine catch 102 may be angled approximately 110 degrees relative to the lever ends or arms 104. This angle of the magazine catch, combined with the location of the cuts 50 in the lower receiver, results in the end of the magazine catch being in the position within the magazine well to properly contact and hold the AK-47 magazine or similar magazine within the magazine well. Other angles and geometries of the magazine catch relative to the lever arms are possible, including angles between approximately 95 and 125 degrees, and are considered within the scope of the invention. In an exemplary aspect, the lever ends or arms extend approximately horizontal above the trigger guard opening on both sides of the lower receiver. The lever arms or ends may also extend at other angles relative to the trigger guard opening and yet provide enough clearance for an operator to insert a finger into the trigger guard opening and still conveniently reach the lever ends or arms to release the magazine from the magazine well.

Once a magazine is inserted into the well, the force exerted by the magazine on the catch end 102 overcomes the biasing force of the torsion spring and rotates the catch end away from the magazine well until the tabbed portion 81 passes the catch end 102 at which point the biasing force of the torsion spring causes the catch end to rotate back towards the magazine well and underneath the tabbed portion 81, thereby catching and holding in position the magazine within the magazine well.

Figure 9:
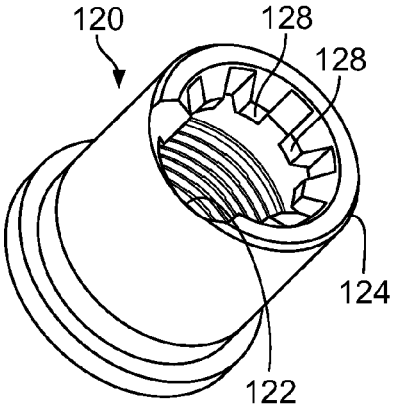
FIG. 9 illustrates an isometric view of an exemplary barrel extension of the firearm of FIG. 1.
Figure 10:
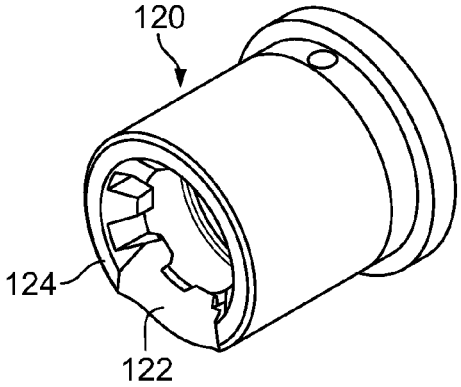
FIG. 10 illustrates another isometric view of an exemplary barrel extension of the firearm of FIG. 1.

Referring to FIGS. 9-10, a barrel extension 120 may be used for connecting the barrel 19 to the upper receiver 14. The barrel extension 120 defines a specially designed feed ramp 122 that permits the AK-47 round (i.e., 7.62×39 mm cartridge) or similar round to properly feed into the barrel. The feed ramp 122 defines an elongated ramped surface extending from the outer peripheral edge 124 of the barrel extension to the bore surface of the barrel. The width of the feed ramp is wider than typical feed ramps and the angle of the feed ramp is flatter than traditional feed ramps to accommodate the AK-47 round or similar round. In one embodiment, the width of the feed ramp is approximately the same distance as the distance between the outer edges of two adjacent locking lugs 128. The feed ramp may also have other widths that permit the proper feed of an AK-47 round or similar round into the barrel.

Referring to FIGS. 7-8 and 17-21, the upper receiver 14 is configured to receive the bolt assembly. The bolt assembly includes a bolt 130 and bolt carrier 132. Concerning the bolt carrier, extra angle cuts may be provided to the carrier to provide more clearance for the AK-47 magazine. The bolt may include an extractor 140 that is mounted to the bolt through the use of an extractor pin which is mounted to opening 141, and an extractor spring, not shown, is used to pivot the extractor relative to the bolt. The bolt also includes opening 142 for the cam pin. Also included on the bolt are an ejector, ejector spring and ejector roll pin, not shown, but understood in the art. Positioned within the bolt 130 is a firing pin, not shown, that is held in position by a firing pin retaining pin, as understood in the art. The bolt carrier 132 includes an elongated cam slot 133.

Figure 15:
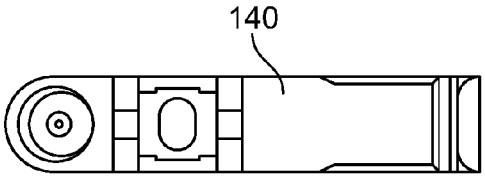
FIG. 15 illustrates a top view of an exemplary extractor of the firearm of FIG. 1.
Figure 16:
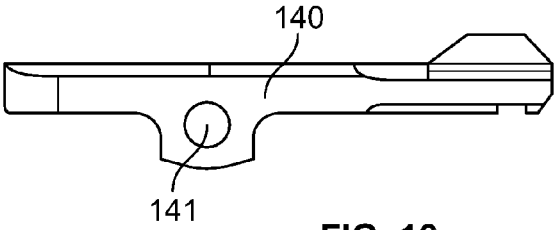
FIG. 16 illustrates a side view of an exemplary extractor of the firearm of FIG. 1.
Figure 17:
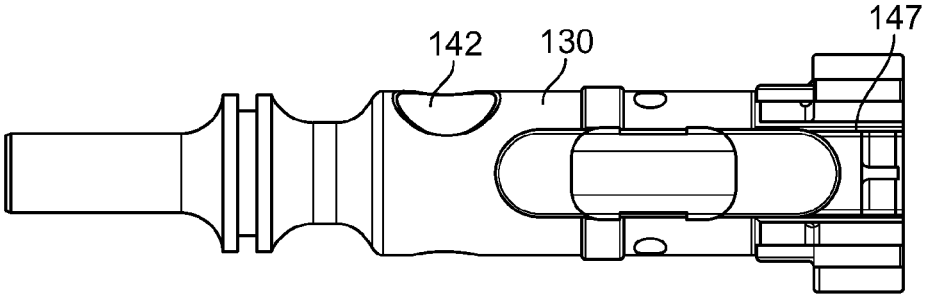
FIG. 17 illustrates a top view of an exemplary bolt of the firearm of FIG. 1.
Figure 18:
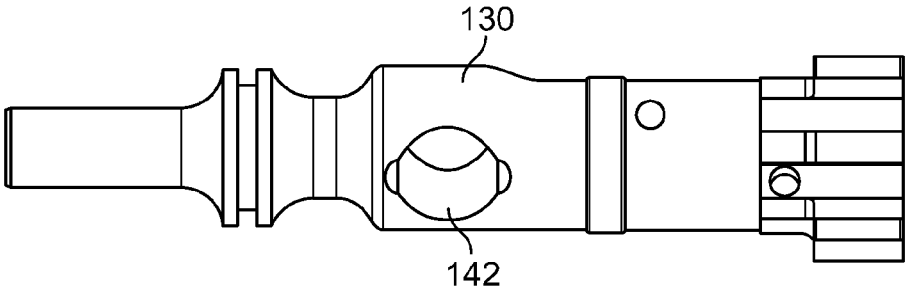
FIG. 18 illustrates a side view of an exemplary bolt of the firearm of FIG. 1.
Figure 19:
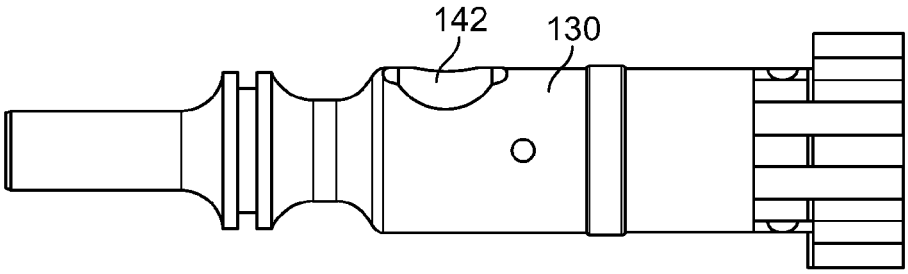
FIG. 19 illustrates a side view of an exemplary bolt of the firearm of FIG. 1.
Figure 20:
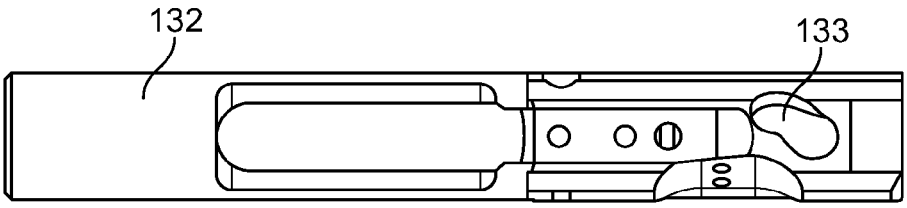
FIG. 20 illustrates a top view of an exemplary bolt carrier of the firearm of FIG. 1.
Figure 21:
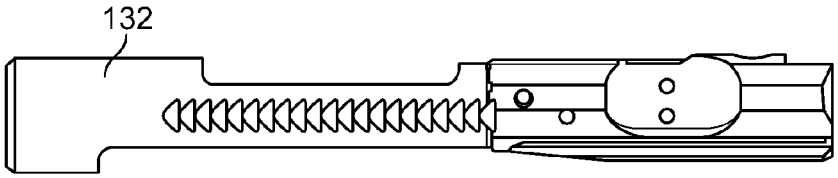
FIG. 21 illustrates a side view of an exemplary bolt carrier of the firearm of FIG. 1.
Figure 22:
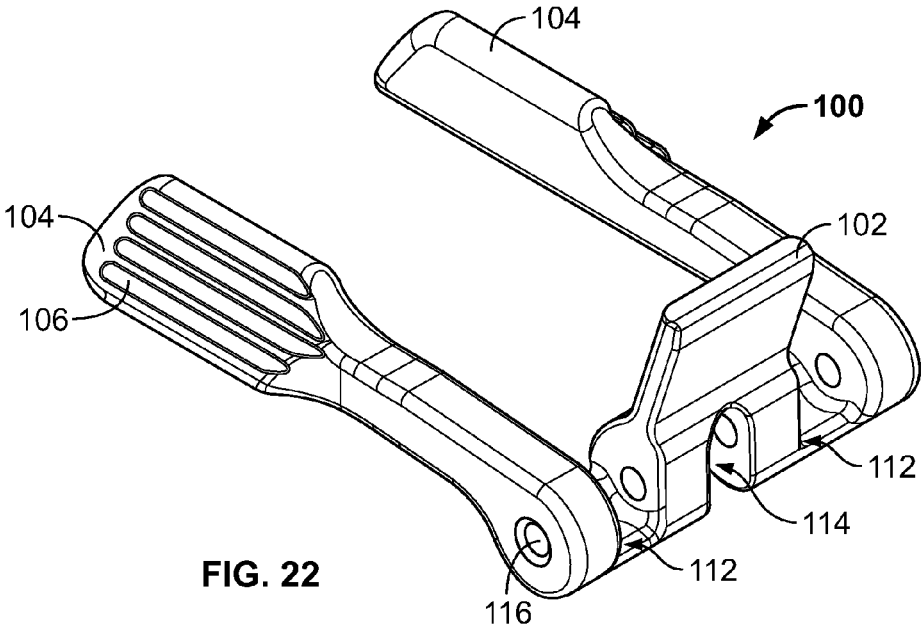
FIG. 22 illustrates an isometric view of an exemplary magazine release of the firearm of FIG. 1.

Referring to FIGS. 15-16, the extractor 140 is increased in size, or oversized, relative to conventional extractors to accommodate the AK-47 round. Clearance cuts 147 are provide in the bolt for the larger extractor 140 to give the extractor more relief to move and pivot.

Slidably mounted within the upper receiver is a charging handle 75 that is operatively connected to the bolt carrier. The charging handle may include a pair of opposing ears that can be operated by either hand to charge the firearm. The charging handle may mount to a channel formed within the upper receiver and may slide within the upper receiver.

In operation, upon the pull and release of the charging handle, the bolt 130 strips a cartridge from the AK-47 magazine or similar magazine mounted to the magazine well and moves the cartridge forward and up the feed ramp and into the barrel 19 as the bolt assembly moves toward a battery position. Once the bolt assembly is in the battery position, the user can activate the trigger. The trigger releases a cocked hammer and the hammer strikes a firing pin. The firing pin moves forward and makes contact with the cartridge. The contact between the firing pin and the cartridge causes the cartridge to fire and the resultant explosion forces a bullet out the end of the barrel along a forward path dependent on the direction the barrel is pointing. The resultant explosion also causes the bolt assembly to recoil in a backward direction opposite of the direction of bullet travel. As the bolt assembly moves backwards toward the stock, the bolt cam pin, riding in a slot on the bolt carrier, forces the bolt to turn and unlock from the barrel extension. Once the bolt is fully unlocked it begins its rearward movement along with the bolt carrier. The bolt's rearward motion extracts the empty cartridge case from the chamber, and as soon as the neck of the case clears the barrel extension, the bolt's spring-loaded ejector forces the empty cartridge out the ejection port in the side of the upper receiver. A buffer spring opposes the backward travel of the bolt assembly and after the buffer spring is sufficiently compressed, i.e., the bolt assembly is in a recoiled position, the compressed spring moves the bolt assembly forward. The bolt's locking lugs then strip a new round from the magazine and the round is guided up the feed ramp and into the chamber. As the bolt's locking lugs move past the barrel extension, the cam pin is allowed to twist in the groove cut into the carrier and forces the bolt to twist and lock into the barrel's extension. The bolt assembly is now in the battery position and another cartridge can be fired. This process is repeated each time the trigger is pulled and a cartridge is fired.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A firearm that combines an AR rifle with an AK magazine, the firearm comprising:

a lower receiver, an upper receiver mounted to the lower receiver, a barrel extension mounted to the upper receiver, the barrel extension defining a wide feed ramp, a barrel mounted to the barrel extension, a handguard surrounding at least part of the barrel, a pistol grip mounted to the lower receiver, an elongated mounting rail positioned above the upper receiver, a stock mounted to the upper receiver, a trigger and trigger assembly mounted to the lower receiver, a trigger guard that extends at least partially around the trigger and is mounted to the lower receiver, wherein the lower receiver defines a magazine well and an elongated groove formed in the magazine well for receiving an AK magazine; and wherein the magazine well defines an angled opening for receiving the magazine, wherein the angled opening extends from a trigger guard mounting hole to a take-down pin hole, an ambidextrous magazine release lever defining a first end forming a magazine catch and a second end forming a pair of lever arms that straddle the lower receiver, wherein the magazine catch is a member that extends into a center of a wall of the magazine well and is spring biased towards the magazine well and the lever arms are positioned laterally outwardly of the magazine catch and on opposing sides of the magazine catch, wherein the magazine release lever is pivotable such that pressing either of the lever arms moves the magazine catch away from the magazine well, and wherein the magazine catch is configured to engage a tabbed portion of the magazine upon insertion of the magazine into the magazine well.

2. The firearm of claim 1, wherein the magazine catch defines an angled end for engagement with the tabbed portion of the magazine.

3. The firearm of claim 1, further comprising a bolt, bolt carrier and an oversized extractor mounted to the bolt.

4. The firearm of claim 3, wherein the bolt defines relief cuts to permit the oversized extractor to move easily relative to the bolt.

5. The firearm of claim 4, further comprising a charging handle operatively mounted to the bolt carrier.

6. The firearm of claim 1, further comprising serrations on surfaces of the lever arms.

7. The firearm of claim 1, wherein the first end of the lever is angled relative to the second end.

8. The firearm of claim 7, further comprising a torsion spring positioned to bias the magazine catch toward the magazine well.

9. The firearm of claim 1, wherein the trigger guard includes opposing cuts at an end to permit the trigger guard to mount to trigger guard mounting walls on the lower receiver.

10. The firearm of claim 1, wherein the lever arms extend substantially horizontally above the trigger.

11. A firearm that combines an AR rifle with an AK magazine, the firearm comprising:

a lower receiver, an upper receiver mounted to the lower receiver, a barrel extension mounted to the upper receiver, the barrel extension defining a wide feed ramp, a barrel mounted to the barrel extension, a handguard surrounding at least part of the barrel, a pistol grip mounted to the lower receiver, an elongated mounting rail positioned above the upper receiver, a stock mounted to the upper receiver, a trigger and trigger assembly mounted to the lower receiver, and a trigger guard that extends at least partially around the trigger and mounted to the lower receiver, wherein the lower receiver defines a magazine well and an elongated groove formed in the magazine well for receiving an AK magazine;

wherein the magazine well defines an angled opening for receiving the magazine, wherein the angled opening extends from a trigger guard mounting hole to a take-down pin hole, an ambidextrous magazine release lever located behind the magazine well, the magazine release lever defining a first end forming a magazine catch and a second end forming a pair of lever arms that straddle the lower receiver, wherein the lower receiver defines a cut on both sides of the firearm that serves as a rotational stop for the release lever, wherein the magazine catch is a member that extends into a center of the magazine well and is spring biased towards the magazine well and the lever arms are positioned laterally outwardly of the magazine catch and on opposing sides of the magazine catch, wherein the magazine release lever is pivotable such that pressing either of the lever arms moves the magazine catch away from the magazine well, and wherein the magazine catch is configured to engage a tabbed portion of the magazine upon insertion of the magazine into the magazine well.

12. The firearm of claim 11, wherein the magazine catch defines an angled end for engagement with the tabbed portion of the magazine.

13. The firearm of claim 11, further comprising a bolt, bolt carrier and an oversized extractor mounted to the bolt.

14. The firearm of claim 13, wherein the bolt defines relief cuts to permit the oversized extractor to move easily relative to the bolt.

15. The firearm of claim 14, further comprising a charging handle operatively mounted to the bolt carrier.

16. The firearm of claim 11, further comprising serrations on ends of the arms.

17. The firearm of claim 16, wherein the lever arms are joined by a bracket extending between the lever arms, and wherein the bracket defines a cut for receiving a torsion spring.

18. The firearm of claim 11, wherein the trigger guard includes opposing cuts at an end thereof to permit the trigger guard to mount to trigger guard mounting walls on the lower receiver.

19. The firearm of claim 18, wherein the lever arms extend substantially horizontally above the trigger.

20. The firearm of claim 11, wherein the mounting rail is configured to mount firearm accessories, including sights, lights and optics.

* * * * *